United States Patent [19]

McDade

[11] Patent Number: 5,076,028

[45] Date of Patent: Dec. 31, 1991

[54] HOUSING FOR BLAST WHEEL

[76] Inventor: Bernard F. McDade, 209 Aiken Rd., Chattanooga, Tenn. 37421

[21] Appl. No.: 510,951

[22] Filed: Apr. 19, 1990

[51] Int. Cl.[5] ..... B24C 3/00

[52] U.S. Cl. ..... 51/410; 51/426; 51/432

[58] Field of Search ..... 51/410, 426, 431, 432, 51/433, 434, 269

[56] References Cited

U.S. PATENT DOCUMENTS

| | | | |
|---|---|---|---|
| 3,660,943 | 5/1972 | Barnthouse | 51/434 |
| 3,744,190 | 7/1973 | DeGroot et al. | 51/431 |
| 4,176,502 | 12/1979 | Leliaert | 51/434 |
| 4,291,509 | 9/1981 | Schulte et al. | 51/431 |
| 4,300,318 | 11/1981 | Brown | 51/425 |

*Primary Examiner*—M. Rachuba

*Attorney, Agent, or Firm*—James B. Middleton

[57] ABSTRACT

A housing for a blast wheel has front and rear walls supported from a base plate, and openable end walls for providing access to the blast wheel. The top is also openable, but the top may be only slightly opened to allow the end walls to be fully opened for easy access to the blast wheel and the housing liners. Each of the walls, and the top, has a one-piece liner, all of which can be changed through the ends of the housing. Latches selectively latch the end walls to the front and rear walls, and selectively latch the top to the end walls. The top and end liners rest on the edges of the front and rear wall liners so removal and replacement is very simple.

7 Claims, 2 Drawing Sheets

HOUSING FOR BLAST WHEEL

INFORMATION DISCLOSURE STATEMENT

Blast wheels are very common in industry; and, like other tools, the blast wheel is treated somewhat with contempt until repairs must be made. Specifically, the blast wheel is to perform a function, so the blast wheel is frequently mounted in very close quarters, further crowded by other equipment, and disposed at any angle that suits the function to be performed.

When a blast wheel must be serviced, the above mentioned proclivities render the servicing extremely difficult. The blast wheel includes a hopper to receive shot being fed to the blast wheel, and a feed trough is frequently closely adjacent to the cover of the blast wheel housing. The cover is generally the only opening into the blast wheel housing, except of course for the open bottom where the shot is discharged. Thus, either a considerable amount of equipment must be disassembled, or all work on a blast wheel must be through the bottom discharge opening.

Those skilled in the art will realize that the liners in the blast wheel conventionally comprise at least a dozen pieces, and frequently more than that. The large number of pieces, the confined space and limited access combine to render service extremely difficult.

SUMMARY OF THE INVENTION

This invention relates generally to blast wheels, and is more particularly concerned with a housing for a blast wheel, the housing providing easy access for servicing of the blast wheel.

The present invention provides a housing for a blast wheel, the housing having openable ends and an openable top. The front and rear liners are one piece each, the end liners are one piece each, and the top liner is one piece. Since both the top and the ends of the housing can be opened, all service can be accomplished from the top side of the wheel housing, including the complete rebuilding of the wheel when necessary. Furthermore, the ends of the housing can be opened, and most of the service can be accomplished without the necessity for fully opening the top of the housing.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
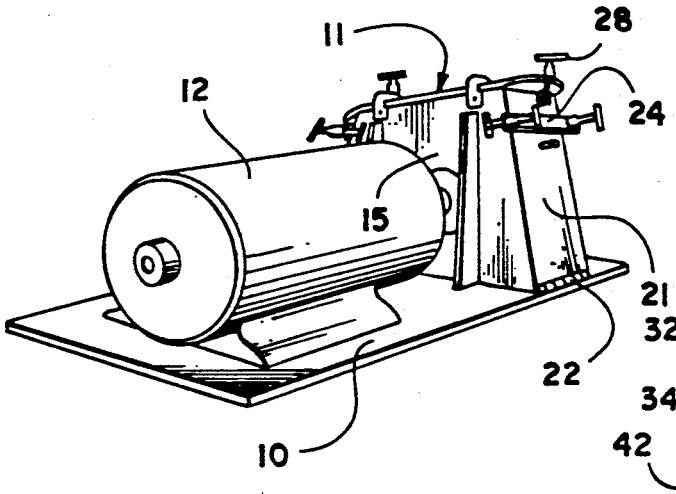
FIG. 1 is a perspective view of a blast wheel showing the closed housing and the drive motor.

Referring now more particularly to the drawings, and to that embodiment of the invention here presented by way of illustration, it will be seen in FIG. 1 that the blast wheel assembly is mounted on a base plate 10. The base plate 10 carries the blast wheel housing generally designated at 11 and the drive motor 12. Those skilled in the art will understand that there is a hopper on the front side of the housing 11 for feeding shot to the blast wheel within the housing 11.

All blast wheels require occasional replacement of the blades that propel the shot from the housing, and replacement is rather frequent in some blast wheels. Also, the housing has liners to prevent damage to the housing itself. In some blast wheels, the top and end liners must be replaced rather frequently. If the liners are destroyed and the blast wheel is operated, the housing itself will be quickly destroyed.

In conventional blast wheel housings, the front, back and ends are integrally formed. The integral formation is disadvantageous both in lack of easy access to the interior of the housing and in the inability to replace one part of the housing. In spite of these well known inconveniences the prior art housings have been formed integrally. One reason for the integral formation of the housing is that the blast wheel housing must have the strength to contain the blast wheel, even if the entire wheel flies apart.

Figure 2:
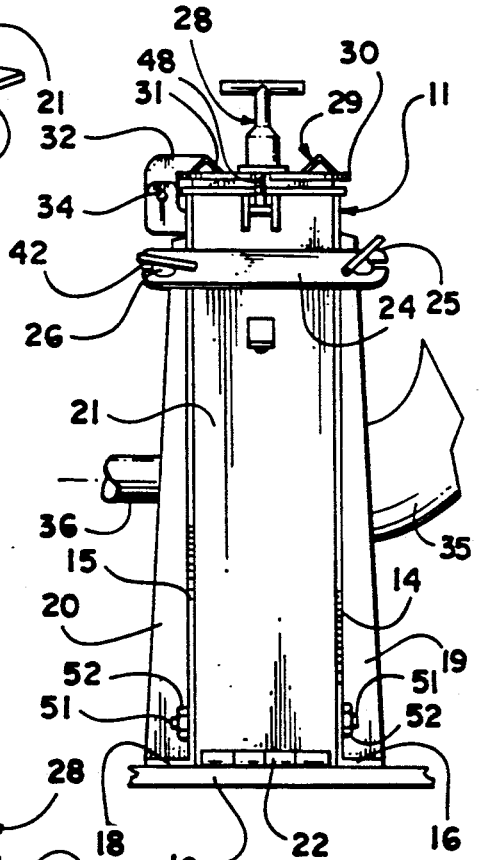
FIG. 2 is an end elevational view of the housing shown in FIG. 1.

With the foregoing in mind, attention is directed to FIGS. 1 and 2 of the drawings where it will be seen that the housing 11 includes a front wall 14 and a rear wall 15. The front and rear walls 14 and 15 have outwardly turned flanges 16 and 18 at their lower edges. To strengthen the walls 14 and 15, there are buttress members 19 fixed to the front wall 14 and the flange 16, and buttress members 20 fixed to the rear wall 15 and the flange 18. The need for these buttress members will be better understood hereinafter.

The end wall 21 of the housing 11 fits snugly between the front wall 14 and the rear wall 15. The lower edge of the end wall 21 is hinged at 22, and the upper end of the end wall 21 is latched by the bar 24, the bar 24 having latches 25 and 26 at its ends. Further, there is a latch 28 that is to hold the top 29 closed; but, the latch 28 is secured to the end wall 21. As a result, when the top 29 is latched, the latch 28 assists in holding the end wall 21 in its closed position.

Looking further at FIG. 2 of the drawings, it will be noticed that the top 29 comprises a generally flat plate 30, the plate 30 being reinforced by a pair of members 31. The reinforcing members 31 are here illustrated as angle irons, but it will be understood that other specific structural members may be utilized.

The hinge 32 is best shown in FIG. 2 of the drawings, and it will be seen that the pivot 34 is disposed beyond the plate 30. This arrangement produces a nearly linear motion of the top 29 as the top begins to open.

FIG. 2 also shows a portion of the hopper 35 for feeding shot to the blast wheel, and the drive shaft 36 for rotating the blast wheel.

Figure 3:
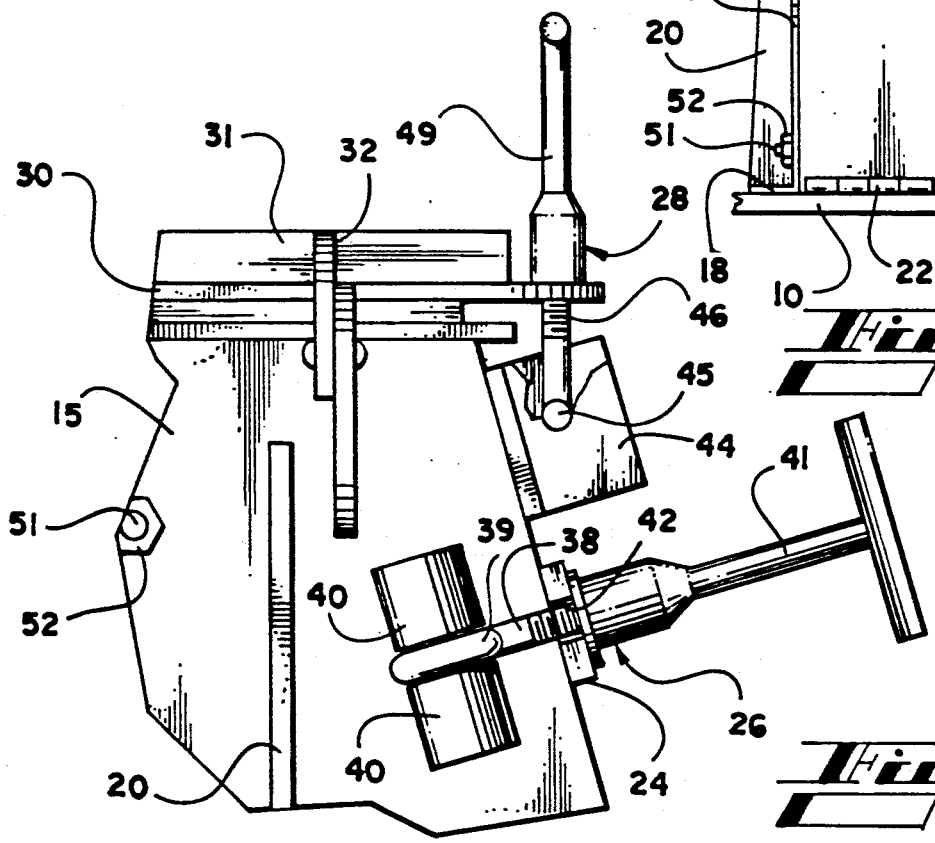
FIG. 3 is an enlarged fragmentary view showing the latches for the top and the end; and, FIG. 4 is an exploded perspective view showing the housing open, and the top and end liners exploded therefrom.

Looking now at FIG. 3 of the drawings, the latches 26 and 28 are shown in more detail. The latch 26 includes a threaded member 38 which is pivotally fixed to the rear wall 15 by means of an eye 39, the eye 39 receiving a shaft held to the rear wall 15 by bosses 40.

There is a securing handle 41 having an appropriately threaded bore to receive the threaded member 38, the securing handle including a T to allow easy manipulation.

It will therefore be understood that the handle 41 can be loosened, so the threaded member 38 can be pivoted at the eye 39 to remove the member 38 from the slot 42. The latch 26 will then be completely released. Conversely, the threaded member 38 can be pivoted about the eye 39 to be received within the slot 42. The handle 41 can then be rotated to tighten the handle 41 against the latch and bar 24 and secure the end plate 21.

It will also be understood that the latch 26 has been described in detail, and the latch 25 is constructed precisely the same. The latch 25 should therefore be understood without a repetition of the foregoing description.

The latch 28 for the top cover 29 is also similar to the latch 26. The latch 28 includes a pair of flanges 44 which pivotally carry the shaft 45, the shaft 45 having the threaded member 46 extending therefrom. The top plate 30 defines a slot 48 for receiving the threaded member 46; and, there is a securing handle 49 which threadedly engages the threaded member 46. Thus, the operation of the latch 28 is the same as the operation of the latch 26. By loosening the securing handle 49, the threaded member 46 can be rotated about the shaft 45 to remove the threaded member 46 from the slot 48. The top 29 will then be free to open. Conversely, the top 29 can be closed, and the shaft 45 can be pivoted to be received within the slot 48 in the plate 30. The securing handle 49 will then be rotated to be urged against the plate 30 for securing the top 29.

Again, there is a latch at each end of the top 29, and only one has been described in detail. The other latch is precisely the same, and the description does not need to be repeated.

Figure 4:
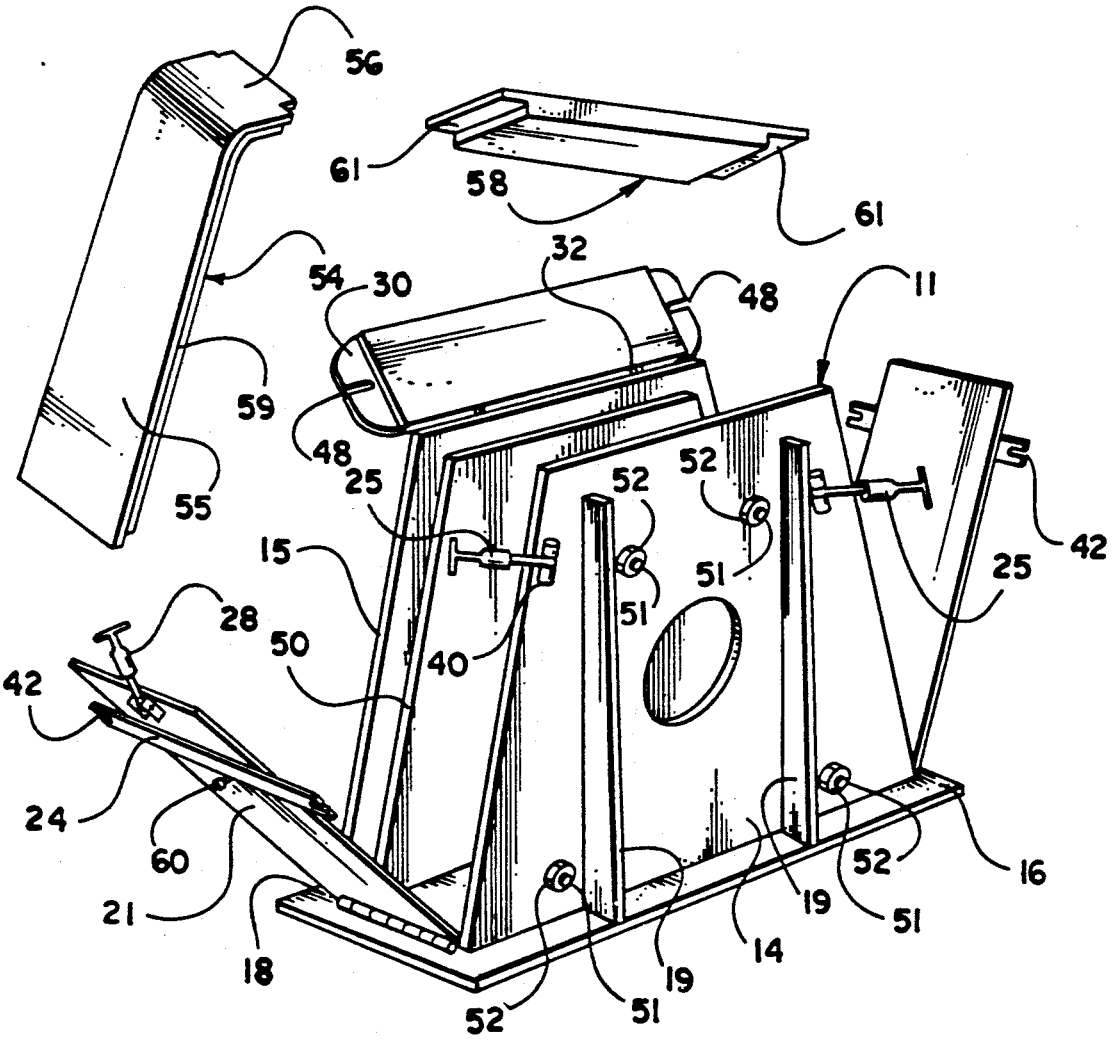

Keeping the above description in mind, attention is directed to FIG. 4 of the drawings which shows the housing opened, and illustrates the liners for the housing. The hopper 35 is removed from the housing for simplicity of illustration, and only one end liner is shown, the other end liner being identical to the one shown.

Looking first at the rear liner, the rear liner 50 is in place within the housing, and is positioned against the rear wall 15. The liner 50 is the same shape as the rear wall 15, but is somewhat smaller. Thus, a rabbeted edge is provided on three sides of the liner 50.

The front liner is not shown but it is identical to the rear liner, and the means for fixing the front and rear liners to the front and rear walls is illustrated. Each of the liners has a plurality of studs 51 extending therefrom. The studs 51 project through appropriate holes in the front and rear walls 14 and 15, and are secured by nuts 52.

The end liners 54 are in one piece each, and include a rectangular end 55, and a top portion 56 that curves to merge with the top liner 58. The edges 59 of the end liner 54 are rabbeted to mate with the rabbeted edges formed by the front and rear walls 14 and 15 and their respective liners such as the liner 50.

Each of the end walls 21 has a screw 60 threaded therethrough. The screws 60 simply bear against the end liners to urge them firmly against the front and rear liners. In the beginning, one can close the housing, then tighten the screws 60 until the liners are well seated. Subsequently, the screws 60 will be fixed and the end liners will be seated when the end walls 21 are closed.

The top liner 58 comprises a generally rectangular plate having end rabbets 59. The rabbets 59 receive the top portions 56 of the end liners 21 to make a tight joint between the end and top liners. Of course, the top liner seats against the rabbeted top edge formed by the front and rear walls 14 and 15 and their respective liners.

The operation of the present invention should be understandable with the above description in mind.

First, it will be understood that the blast wheel housing of the present invention can be used in conventional fashion in that the housing 11 is mounted on a base 10, and a drive motor 12 drives the wheel while a hopper 35 directs shot into the blast wheel. The major differences of the present invention manifest themselves when the blast wheel or the housing must be serviced.

In many blast wheels, the blades that actually propel the shot must be changed rather frequently, and these are very difficult to change due to the limited access to the wheel house. With prior art housings, the only opening through which the wheel can be removed is the bottom. As a result, one must reach through the bottom to detach the wheel from the drive shaft, then catch the wheel. If the top is not completely blocked, some work may be accomplished from the top, but the wheel still must be removed through the bottom which is extremely awkward in most operations.

With the housing 11 of the present invention, the latch 28 can be loosened to release the top plate 30. Even though the top may not be fully openable, the latches 28 can be released and the top raised slightly. This will allow the end walls 21 to clear the top 29. The latches 25 and 26 can then be loosened, and moved to release the end wall 21, so the end wall 21 can be opened. Obviously, the opposite end wall 21 can also be opened if required, so the wheel can be reached from either side. The technique is the same, so only one side will be described in detail.

After the end wall 21 has been opened, it will be remembered that the end liner 54 is simply resting against the front and rear liners 50; thus, the end liner 54 can be removed, giving easy access to the wheel within the housing. The wheel can be serviced through the end wall 21, and the wheel can even be completely removed through the end wall 21.

The above discussion assumes the top 29 is not fully openable; however, if the top is not blocked, the top 29 can be fully opened as is illustrated in FIG. 4. One can then easily remove the top liner 58 for some access to the wheel. Opening at least one of the end walls will then provide excellent access to the blast wheel. Strength of the housing is maintained by the buttress members 19 and 20, and the strong, secure latches.

When liners are to be changed in the wheel housing of the present invention, new liners can easily be substituted for old ones. The removal of the top and end liners is discussed above, and it will be seen that replacement will be quick and easy for one person. When the front and rear liners, such as the liner 50, are to be replaced, the nuts 52 will be removed, allowing the liner to move inwardly of the housing until the studs 51 are free from the wall 15. The liner 50 can then be removed through an open end wall 21, and a new liner placed into the housing.

In the event a liner is not replaced soon enough, it is possible that a wall of the housing can be damaged. With the prior art housings, the entire housing must be replaced when any wall of the housing is damaged. It will be understood, however, that the damage will almost always be to the end walls and the top, and almost never to the front or rear wall. Since the ends and top of the housing 11 are hinged to the housing, it will be understood that the damaged wall can be removed and replaced rather easily.

It will therefore be seen that the blast wheel housing of the present invention provides a versatile housing in which both end walls and the top are openable for servicing the blast wheel and the housing. The housing is strong enough to withstand the maximum forces exerted against it, which would be the force of a wheel flying apart. Further, the walls fit snugly together, holding the liners which are effectively rabbeted on the top and ends of the housing. Since top and ends can be opened, the wheel can be serviced even if the top is blocked by equipment, all service being handled through the end walls. Simple latches hold the housing closed when in use.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. In a housing for a blast wheel, said housing containing a blast wheel, drive means received by said housing for driving the blast wheel, and feed means for feeding shot into said housing, said housing including a front wall carrying said feed means, a rear wall receiving said drive means therethrough, opposed end walls connecting said front and rear walls, and a top engaging all said walls, the improvement comprising a base plate receiving said housing thereon, said end walls being selectively removable from said housing, each end wall of said opposed end walls including a hinge at its lower edge hinging said end wall to said base plate, and latch means for selectively latching said end wall to said front and rear walls.

2. In a housing as claimed in claim 1, said latch means including a latch bar transversely of said end wall, a first latch carried by said front wall and selectively engageable with a first end of said latch bar, and a second latch carried by said rear wall and selectively engageable with a second end of said latch bar.

3. In a housing as claimed in claim 2, the further improvement wherein said top is pivotal relative to said housing, and including a third latch carried by one of said end walls and selectively engageable with one end of said top, and a fourth latch carried by the other of said end walls and selectively engageable with the other end of said top.

4. In a housing as claimed in claim 3, said housing further including an integral rear liner adjacent to said rear wall and defining a rabbet at the edges of said rear wall, an end liner defining rabbeted edges receivable by said rabbet at the edges of said rear wall, and a top liner receivable by said rabbet at the edges of said rear wall, the arrangement being such that said end wall urges said end liner against said rabbet at the edges of said rear wall.

5. In a housing as claimed in claim 4, the further improvement including a screw received by said end wall for engaging said end liner.

6. In a housing as claimed in claim 4, said rear liner including a plurality of studs extending therefrom, said studs extending through said rear wall for attaching said rear liner thereto.

7. In a housing as claimed in claim 1, the further improvement including a plurality of buttresses fixed to said front wall and said base plate for supporting said front wall with respect to said base plate, and a plurality of buttresses fixed to said rear wall and said base plate for supporting said rear wall with respect to said base plate.

* * * * *